US007143594B2

(12) United States Patent
Ludwig et al.

(10) Patent No.: US 7,143,594 B2
(45) Date of Patent: Dec. 5, 2006

(54) CONTROL METHOD FOR OPERATING A REFRIGERATION SYSTEM

(75) Inventors: Bradley M. Ludwig, Minnetonka, MN (US); Peter W. Freund, Bloomington, MN (US)

(73) Assignee: Thermo King Corporation, Minneapolis, MN (US)

( * ) Notice: Subject to any disclaimer, the term of this patent is extended or adjusted under 35 U.S.C. 154(b) by 276 days.

(21) Appl. No.: 10/926,603

(22) Filed: Aug. 26, 2004

(65) Prior Publication Data

US 2006/0042282 A1 Mar. 2, 2006

(51) Int. Cl.
*F25B 41/04* (2006.01)

(52) U.S. Cl. ..... 62/222; 62/159; 62/196.4; 62/226

(58) Field of Classification Search ..... 62/222, 62/225, 226, 228.1, 228.3, 159, 196.4, 197
See application file for complete search history.

(56) References Cited

U.S. PATENT DOCUMENTS

| | | | | |
|---|---|---|---|---|
| RE30,499 | E | 2/1981 | Moody, Jr. et al. | |
| 4,617,804 | A | 10/1986 | Fukushima et al. | |
| 4,850,197 | A | 7/1989 | Taylor et al. | |
| 4,986,084 | A | 1/1991 | Beckhusen | |
| 5,070,706 | A | 12/1991 | Waters et al. | |
| 5,123,252 | A | 6/1992 | Hanson | |
| 5,189,883 | A * | 3/1993 | Bradford | 62/83 |
| 5,228,301 | A | 7/1993 | Sjoholm et al. | |
| 5,386,700 | A | 2/1995 | Hyde | |
| 5,408,836 | A | 4/1995 | Sjoholm et al. | |
| 5,410,889 | A | 5/1995 | Sjoholm et al. | |
| 5,465,586 | A | 11/1995 | Sjoholm et al. | |
| 5,465,587 | A | 11/1995 | Sjoholm et al. | |
| 5,477,695 | A | 12/1995 | Sjoholm et al. | |
| 5,598,718 | A | 2/1997 | Freund et al. | |
| 5,711,161 | A | 1/1998 | Gustafson | |
| 5,884,494 | A | 3/1999 | Okoren et al. | |
| 5,907,957 | A | 6/1999 | Lee et al. | |
| 6,017,192 | A | 1/2000 | Clack et al. | |
| 6,047,556 | A * | 4/2000 | Lifson | 62/196.2 |
| 6,095,427 | A | 8/2000 | Hoium et al. | |
| 6,318,101 | B1 | 11/2001 | Pham et al. | |
| 6,467,287 | B1 | 10/2002 | Sjoholm et al. | |
| 6,494,699 | B1 | 12/2002 | Sjoholm et al. | |
| 6,539,734 | B1 | 4/2003 | Weyna | |
| 6,571,566 | B1 | 6/2003 | Temple et al. | |
| 6,679,074 | B1 | 1/2004 | Hanson | |
| 6,745,584 | B1 | 6/2004 | Pham et al. | |
| 2005/0022544 | A1 * | 2/2005 | Chin et al. | 62/222 |

* cited by examiner

*Primary Examiner*—Marc Norman
(74) *Attorney, Agent, or Firm*—Michael Best & Friedrich LLP

(57) ABSTRACT

A method of controlling a heating cycle of a refrigeration system is provided that includes a refrigerant circuit. The refrigerant circuit includes a compressor having a suction port and an outlet having a discharge port with a hot gas compressor discharge line, a condenser for condensing the refrigerant, an evaporator for evaporating the refrigerant and an expansion valve. The method includes using refrigerant from the hot gas compressor discharge line to heat the evaporator during a heating cycle, detecting periodically a discharge superheat of the refrigerant leaving the outlet of the compressor, producing a control signal representing a difference between the detected discharge superheat and a minimum discharge superheat setpoint, adjusting the flow rate of the refrigerant to the suction port of the compressor according to the control signal so as to maintain the discharge superheat of the refrigerant at the outlet of the compressor substantially at the minimum discharge superheat setpoint.

15 Claims, 3 Drawing Sheets

CONTROL METHOD FOR OPERATING A REFRIGERATION SYSTEM

BACKGROUND OF THE INVENTION

The invention relates to control methods for operating a refrigeration system which maintains a temperature set point by heating and cooling cycles, and more specifically to methods for enhancing the heating cycles of such systems.

Refrigeration systems capable of operating in a heating and defrosting mode are known in the art. Exemplary patents in this regard are commonly assigned U.S. Pat. Nos. 4,850,197; 5,228,301; 5,408,836; 5,410,889; 5,465,586; 5,465,587; 5,477,695; and 5,598,718, the disclosures of which are incorporated by reference herein. Such refrigeration systems generally employ a refrigerant compressor that is typically driven by an internal combustion engine in transport refrigeration systems. The compressor is connected to a refrigeration circuit that generally comprises a condenser coil for condensing gaseous refrigerant into a liquid, and an evaporator assembly that includes an expansion valve for converting the liquid refrigerant back into a gas, and an evaporator coil that is thermally connected to a conditioned space, which may be a truck trailer.

To achieve heating and defrosting, these systems typically incorporate a three-way mode valve to divert hot, gaseous refrigerant around the expansion valve of the evaporator assembly and directly into the evaporator coil. This converts the evaporator coil into a heat radiating condenser for either defrosting or heating applications. Such systems employ heat exchangers for transferring additional heat to the gaseous refrigerant to enhance the efficiency of the heating cycle. This additional heat may be provided from sources such as the hot liquid coolant of the radiator system of the internal combustion engine used to drive the compressor.

The foregoing illustrates existing refrigeration systems. It would be advantageous to provide an alternative refrigeration system having enhanced heat outputs during heating cycles including the features more fully disclosed hereinafter.

SUMMARY OF THE INVENTION

According to the present invention, a method of controlling a heating cycle of a refrigeration system is provided that includes a refrigerant circuit. The refrigerant circuit includes a compressor having a suction port and an outlet having a discharge port with a hot gas compressor discharge line, a condenser for condensing the refrigerant, an evaporator for evaporating the refrigerant and an expansion valve. The method includes using refrigerant from the hot gas compressor discharge line to heat the evaporator during a heating cycle, detecting periodically a discharge superheat of the refrigerant leaving the outlet of the compressor, producing a control signal representing a difference between the detected discharge superheat and a minimum discharge superheat setpoint, adjusting the flow rate of the refrigerant to the suction port of the compressor according to the control signal so as to maintain the discharge superheat of the refrigerant at the outlet of the compressor substantially at the minimum discharge superheat setpoint.

The foregoing and other aspects will become apparent from the following detailed description of the invention when considered in conjunction with accompanying drawing figures.

DETAILED DESCRIPTION OF THE INVENTION

It is to be understood that the invention is not limited in its application to the details of construction and the arrangement of components set forth in the following description or illustrated in the following drawings. The invention is capable of other embodiments and of being practiced or of being carried out in various ways. Also, the phraseology and terminology used herein is for the purpose of description and should not be regarded as limiting. The use of "including," "comprising," or "having" and variations thereof herein is meant to encompass the items listed thereafter and equivalents thereof as well as additional items.

According to the present invention, a method for operating a refrigeration system is provided. More specifically, the method provided optimizes the heat output of a refrigeration system during heating cycles by introducing refrigerant into the compressor suction to force more refrigerant into these cycles. Although the heating capacity of a conventional refrigeration system typically decreases, for example, at low ambient temperatures (generally, below zero degrees Celsius) and is also highly dependent on the superheat setting of the economizer expansion valve, the control method of the present invention improves heating capacity to address such ambient and refrigerated space conditions. Responsive to these and other factors, the control method automatically increases or decreases the amount of liquid refrigerant injected via the liquid injection valve to maintain the heating capacity at a maximum level.

Figure 1:
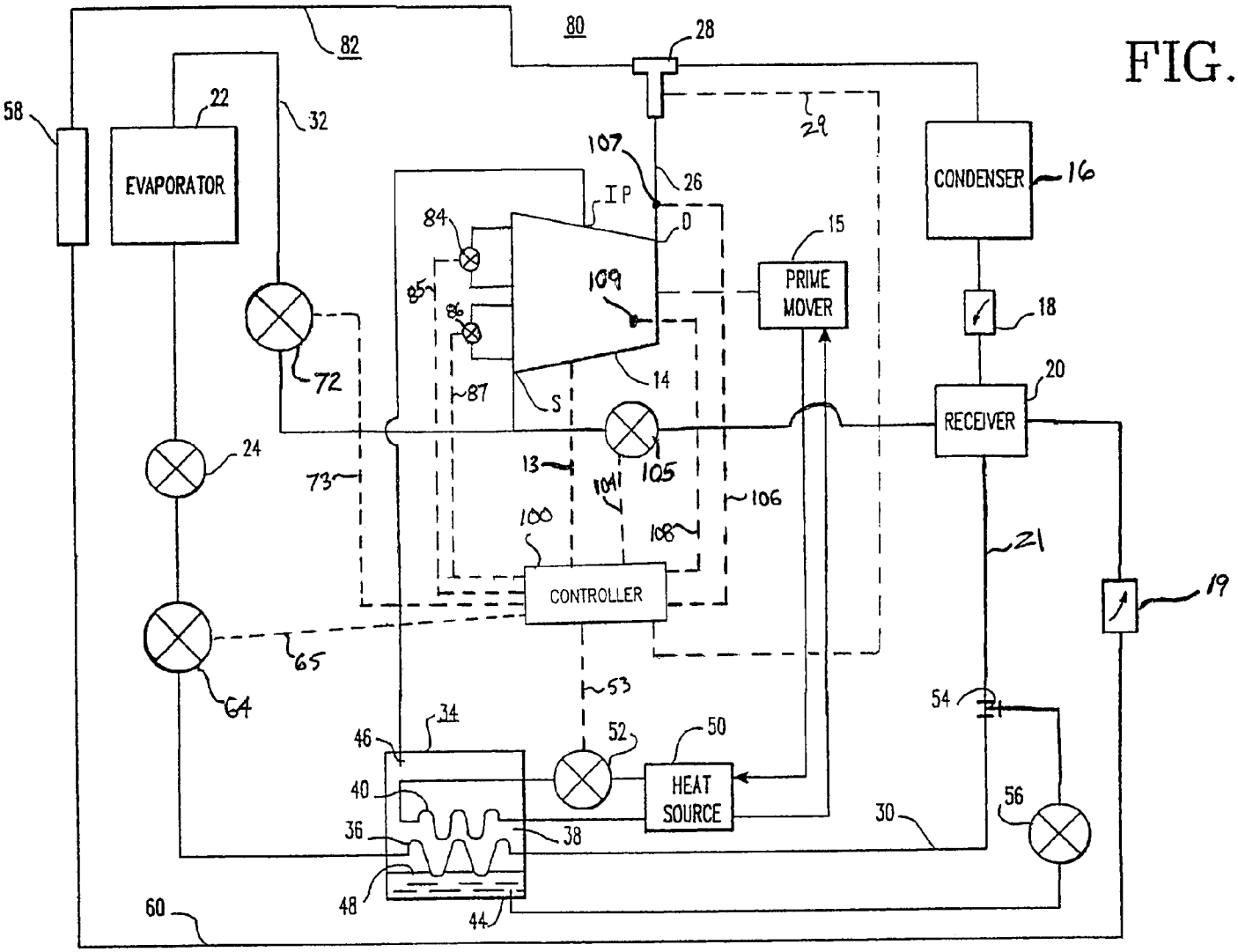
FIG. 1 is a block diagram of a refrigeration system utilizing a control method according to the present invention.

Referring now to the drawings, and to FIG. 1 in particular, there is shown an exemplary refrigeration system 80 having a control method according to the present invention. Refrigeration system 80, for example, may be a transport refrigeration system suitable for conditioning the air in a cargo space of a truck, trailer, or container. In general, refrigeration system 80 is of the type which maintains a temperature set point of a served space by heating and cooling cycles, both of which utilize the hot gas discharged from the discharge port of a refrigerant compressor. Defrosting of the evaporator section of such a refrigeration system may also be accomplished by using the hot gas compressor discharge.

More specifically, refrigeration system 80 includes a refrigerant circuit 82 comprising a compressor 14 driven by a prime mover 15, a condenser 16, check valves 18 and 19, a receiver 20, an evaporator 22, and an expansion valve 24 for evaporator 22. Downstream of evaporator 22 is an electronic throttle valve (ETV) 72 that controls the gaseous refrigerant flow entering suction port S to prevent the pressure from becoming high enough to overload the prime mover 15 that drives the compressor 14. Compressor 14 is of the type having a suction port S, an intermediate pressure port IP, and a discharge port D, and two loading valves LV1 and LV2 described in detail below. A hot gas compressor discharge line 26 connects the discharge port D of compressor 14, to condenser 16 via a three-way valve 28, or its equivalent in two separate coordinated valves. A receiver outlet conduit 21 and a liquid line 30 interconnect receiver 20 and evaporator expansion valve 24, and a suction line 32 interconnects evaporator 22 and the suction port S of compressor 14.

A heat exchanger 34, which will be referred to as an economizer heat exchanger, has first, second and third flow paths 36, 38, and 40, respectively. The first flow path 36 is connected in the liquid line 30. The second flow path 38 is disposed about the first and third flow paths, 36 and 40, respectively, includes an inlet 44 and an outlet 46. The third flow path 40 is connected to a controllable source 50 of heat, with the control, for example, being in the form of a solenoid controlled valve 52. The heat source 50 is outside refrigerant circuit 82, and is preferably a fluid that is heated by operation of the compressor prime mover 15. For example, prime mover 15 may be an internal combustion engine, such as a Diesel engine, and the heat source 50 may be liquid radiator coolant, or exhaust gas.

Receiver outlet conduit 21 is diverted via a tee 54 through economizer expansion valve 56 where it is expanded. The expanded refrigerant is then introduced into the second flow path 38 of economizer heat exchanger 34. The expanded refrigerant is in heat exchange relation with the first flow path 36, to cool refrigerant in the first flow path 36 during a cooling cycle of refrigeration system 80, to enhance the cooling cycle.

As is common with compressors which have an intermediate pressure port IP, a normally closed first loading valve (LV1) 84, called an economizer by-pass valve, is connected between the suction and intermediate pressure ports S and IP, respectively, of compressor 14. A second loading valve (LV2) 86 is similarly connected between the suction port S and a higher pressure, intermediate point within compressor 14. The first loading valve (LV1) 84 and second loading valve (LV2) 86 are solenoid-operated valves that are internally located within compressor 14 and controlled to open during heating and defrost cycles. These loading valves can be like those disclosed in commonly assigned U.S. Pat. Nos. 6,467,287 and 6,494,699, the disclosures of which are incorporated by reference herein. During heating and defrost cycles the normal flow to suction port S is closed. If the compressor pumps only through the limited economizer port, the pumping capability may be limited.

When heat is required by a served space to maintain the temperature set point, and also when heat is required in order to defrost evaporator 22, three-way valve 28 is operated to divert the hot gas in hot gas line 26 to perform an evaporator heating function. In FIG. 1, evaporator 22 is heated by a heating element 58 disposed in heat exchange relation with evaporator 22, such as by a separate set of tubes in the evaporator tube bundle. Refrigerant leaving evaporator heating element 58, which is functioning as a condenser, is led via a second or alternate path or line 60 through an open check valve 19 directly into the receiver 20. Check valve 18 is closed such that none of the liquid refrigerant enters the condenser 16. The liquid refrigerant that collects in the receiver 20 then exits via receiver outlet conduit 21. During a heating or defrost cycle, a liquid line solenoid valve (LLSV) 64 in liquid line 30 is closed to ensure that the refrigerant returns to compressor 14 via the economizer expansion valve 56 and the second flow path 38 of economizer heat exchanger 34 and to stop the flow of refrigerant to the evaporator 22 to stop the cooling of the conditioned space.

Also, during heating and defrosting cycles, solenoid valve 52 is opened to allow hot fluid from heat source 50 to circulate through the third flow path 40, adding heat to refrigerant in the second flow path 38, to enhance the heating and defrosting cycles. Thus, during heating and defrosting cycles, the economizer heat exchanger 34 functions as an evaporator, adding heat from a source 50 outside refrigerant circuit 82 to the refrigerant, to get more heat into the heating and defrosting functions. The heat added to refrigerant in the second flow path 38 by heat source 50 vaporizes any liquid refrigerant 48 that may have accumulated in the second flow path 38, with outlet 46 only allowing vaporized refrigerant to be drawn into the intermediate pressure port IP of compressor 14.

The system 80 includes a controller 100, which may be implemented as a single controller or a plurality of controllers working in concert. As is known in the art, the controller 100 may be operably connected to control operation of the compressor 14; solenoid valve 52; three-way valve 28; liquid line solenoid valve (LLSV) 64; electronic throttle valve (ETV) 72; first loading valve (LV1) 84; second loading valve (LV2) 86; and liquid injection valve (LIV) 105 via electrical lines 13, 53, 29, 65, 73, 85, 87, and 104, respectively, as shown.

The present invention, includes a control method that improves the system capacity of a refrigeration unit in a heating mode by maximizing the heat output of a refrigeration unit while also protecting the compressor of the unit from lubrication loss during a heating cycle. The control method utilizes a control algorithm in the software of microprocessor controller 100 to control a liquid injection valve (LIV) 105 that fluidly connects receiver 20 to the suction port S of compressor 14. An electrical line 104 provides command signals from controller 100 to liquid injection valve 105. Controller 100 is also connected via an electrical line 108 to a compressor discharge temperature sensor 109 that is in contact with the compressor lubricant/refrigerant mixture so as to sense the compressor discharge temperature (CTemp). An electrical line 106 is also provided that connects controller 100 to a discharge pressure transducer (DPT) 107 that reads the saturated discharge pressure of the refrigerant. As described in detail below, the saturated discharge pressure is converted by controller 100 to the saturated compressor discharge temperature ($DTemp_{SAT}$), which is compared to the measured compressor discharge temperature (CTemp) to derive the compressor discharge superheat (CDSH).

The software algorithm monitors the compressor discharge superheat and controls the liquid injection valve in the refrigeration unit to inject a maximum amount of liquid refrigerant into the compressor to provide maximum heating capacity without injecting too much liquid refrigerant, thereby minimizing the washing out of lubricating oil from the compressor. If a calculated compressor discharge superheat is high, liquid injection valve 105 is controlled by controller 100 via electrical line 104 to inject refrigerant into suction port S. This increases mass flow of the refrigerant which maximizes the heat output during heating. If the calculated compressor discharge superheat is below a minimum setpoint, liquid refrigerant injection through liquid injection valve 105 is disabled by controller 100 thereby minimizing lubricant loss from compressor 14.

Figure 2:
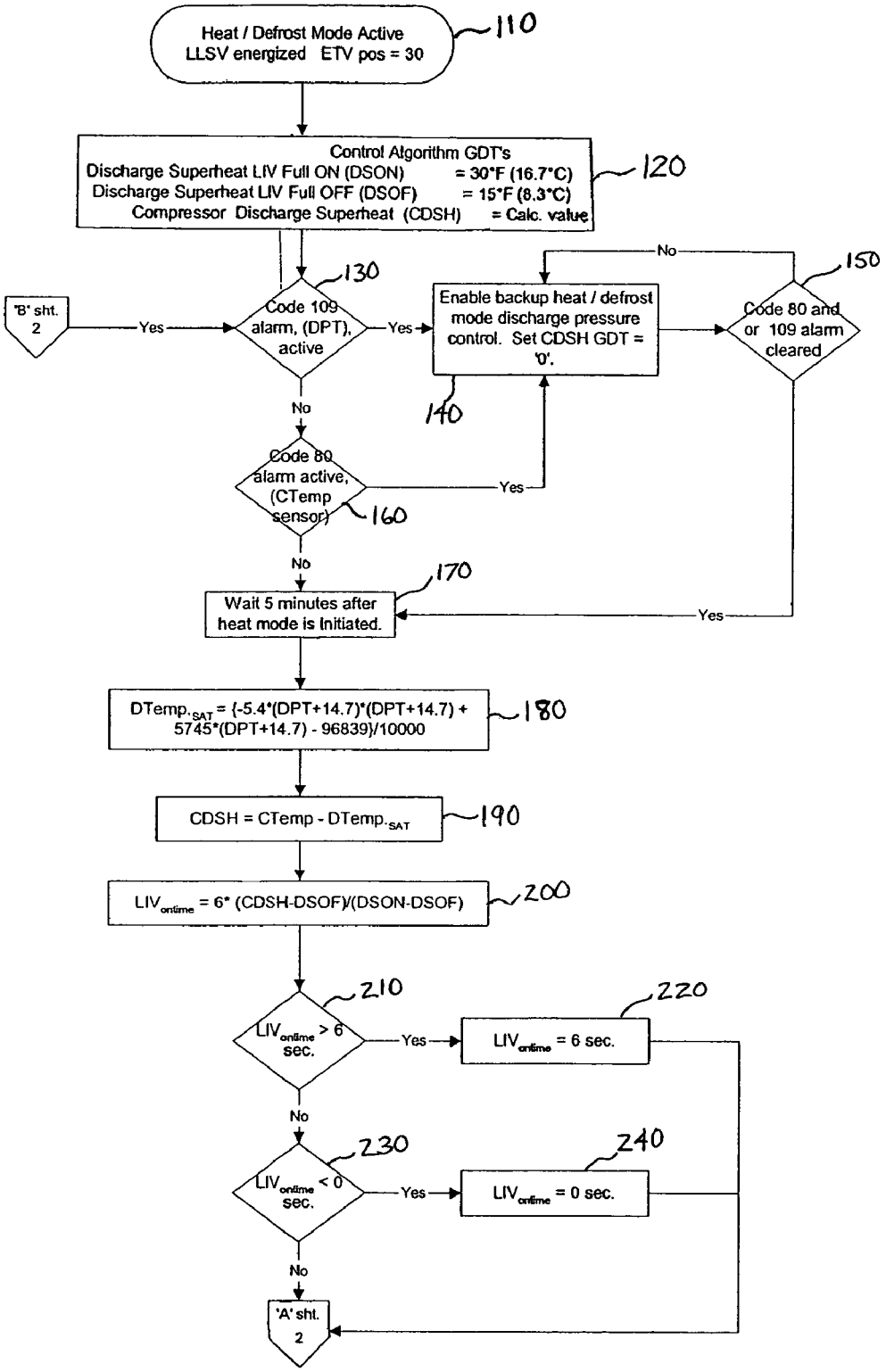
FIGS. 2 and 3 are flow charts of a control method according to the present invention.
Figure 3:
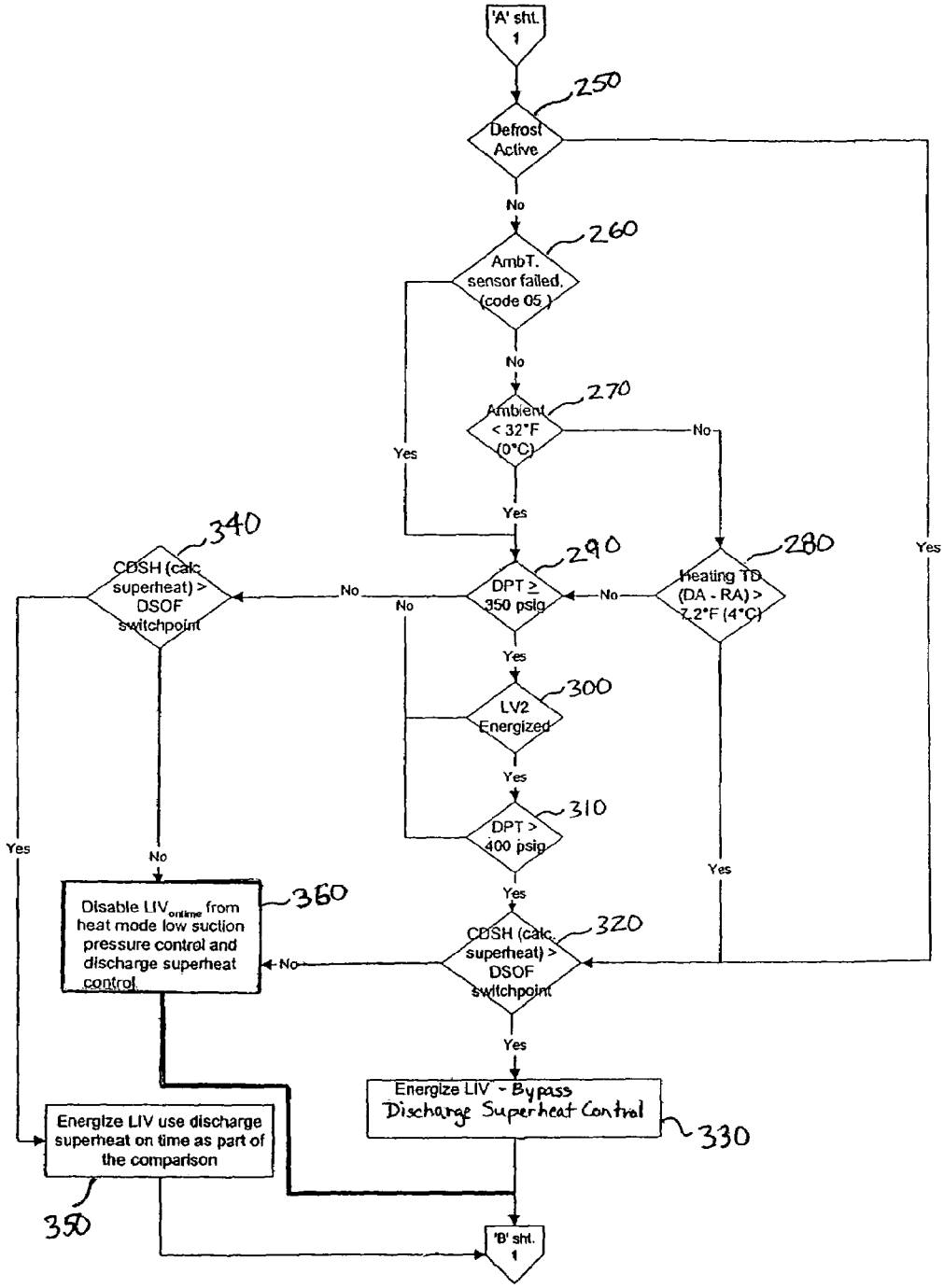

Referring to FIGS. 2 and 3, the control algorithm is shown which calculates and controls the compressor discharge superheat beginning with Step 110 in which Liquid Line Solenoid Valve (LLSV) 64 is energized to close and three-way valve 28 is shifted to direct refrigerant to heating element 58 for beginning a heat/defrost cycle. The electronic throttle valve (ETV) 72 is initially set at 30 percent open.

INITIALIZATION

An initialization step 120 sets the values for the algorithm variables including maximum and minimum setpoint temperature values of the compressor discharge superheat at which the liquid injection valve is opened (DSON) and is closed (DSOF), respectively. These values are read from a global data table (GDT) of the microprocessor controller 100 and can be modified by an operator. If other than the startup cycle, also read is the calculated value of the compressor discharge superheat value (CDSH).

SENSOR READINGS AND FAILURE CHECK

The algorithm in Steps 130 and 160 reads the compressor discharge pressure from discharge pressure transducer (DPT) 107 and the compressor discharge temperature (CTemp) from temperature sensor 109, respectively, and provide alarm signals in the event of their failure. If after initiating the heat mode both the pressure transducer and the temperature sensor are determined to be functioning and no alarm signals present, then a five minute wait period is provided in Step 170 to allow the compressor discharge pressure and temperature to stabilize in the heat mode. This step is performed only during the first startup cycle. The global data table value for the compressor discharge superheat (CDSH) is set to zero during this five minute wait period.

If either the pressure transducer or the temperature sensor are not functioning, then backup control is provided in Step 140 in which a backup heat/defrost mode is performed which continually loops to check whether the alarm signals have been cleared in Step 150. If the unit has been running in heat after an alarm signal has been cleared, the controlled LIV operation based on discharge superheat described below is immediately enabled and the global data table value for the compressor discharge superheat (CDSH) is set to zero.

CONTROLLED LIQUID INJECTION VALVE (LIV) OPERATION BASED ON DISCHARGE SUPERHEAT

The algorithm proceeds to Step 180 in which the discharge saturation temperature ($DTemp_{SAT}$) is calculated from the compressor discharge pressure value from the formula:

$$DTemp_{SAT}=[-5.4*(DPT+14.7)*(DPT+14.7)+5745*(DPT+14.7)-96839]/10000$$

The compressor discharge superheat (CDSH) is then calculated in Step 190, which is the difference between the compressor discharge temperature (CTemp) and the discharge saturation temperature ($DTemp_{SAT}$). In Steps 200–240, the value of the on time for the liquid injection valve ($LIV_{ontime}$) is calculated as a percentage of a six-second cycle using pulse-width modulation. As shown in Step 200, the formula for calculating $LIV_{ontime}$ is:

$$LIV_{ontime}=6*(CDSH-DSOF)/(DSON-DSOF)$$

The calculated $LIV_{ontime}$ is then checked in Steps 210 and 230 and, if greater than six, reassigned a value of six seconds (Step 220) and, if less than zero, reassigned a value of zero seconds (Step 240).

DISCHARGE SUPERHEAT CONTROL BYPASS

Before proceeding with injecting liquid refrigerant to compressor 14 via liquid injection valve 105, various parameters of the refrigeration system are first checked to determine whether discharge superheat control using the $LIV_{ontime}$ from Steps 200 to 240 is to be bypassed. This is accomplished in Steps 250 to 310, which check to see whether:

1) the defrost mode is active (Step 250);
2) an ambient temperature sensor (not shown) outside of the conditioned space is working (Step 260) and, if so, whether the ambient temperature is moderate, i.e., greater than or equal to zero Celsius (Step 270) and there is an adequate temperature differential (TD) between the discharge air temperature (DA) and the return air temperature (RA) of the conditioned space, i.e., greater than 7.2° F. (4° C.) (Step 280); or
3) if the discharge pressure of the compressor (DPT) is high, i.e., greater than or equal to 350 psig if LV1 alone is energized or greater than 400 psig if LV2 is also energized (Steps 290–310).

In the event that any of the three conditions above are true, and if the compressor discharge superheat (CDSH) is greater than the minimum compressor discharge superheat setpoint (DSOF) as determined by Step 320, then discharge superheat control using the $LIV_{ontime}$ from Steps 200 to 240 is bypassed. In this case, the liquid injection valve (LIV) is energized, however, the $LIV_{ontime}$ is not based on discharge superheat control of the present invention. In this instance, the $LIV_{ontime}$ may be based on other parameter(s) such as the compressor temperature and using other algorithms as will be recognized by those skilled in the art.

LIQUID INJECTION BASED ON DISCHARGE SUPERHEAT

If the unit is not in defrost mode (Step 250), the ambient temperature is not detected (Step 260) or is low (Step 270), and the discharge pressure is low (Steps 290–310), then the algorithm evaluates the compressor discharge superheat in Step 340. If the compressor discharge superheat (CDSH) is greater than the minimum compressor discharge superheat set point (DSOF), then discharge superheat control is performed in Step 350 using the maximum $LIV_{ontime}$ calculated in Steps 200–240.

LIQUID INJECTION VALVE DISABLE

If in either Steps 320 or 340 the compressor discharge superheat (CDSH) is less than or equal to the minimum compressor discharge superheat set point (DSOF), then the liquid refrigerant injection is disabled in Step 360 to prevent overfeeding of refrigerant into the compressor by the liquid injection valve. In both cases, the liquid injection valve (LIV) is energized, however, the $LIV_{ontime}$ is not based on discharge superheat control of the present invention. In these instances, the $LIV_{ontime}$ may be based on other parameter(s) such as the compressor temperature and/or the ratio of the discharge pressure to the suction pressure, while using other algorithms as will be recognized by those skilled in the art.

From Steps 330, 350, and 360, the algorithm repeats beginning with taking sensor readings in Step 130.

While embodiments and applications of this invention have been shown and described, it will be apparent to those skilled in the art that many more modifications are possible without departing from the inventive concepts herein described. It is understood, therefore, that the invention is capable of modification and therefore is not to be limited to the precise details set forth. Rather, various modifications may be made in the details within the scope and range of equivalents of the claims without departing from the spirit of the invention.

What is claimed is:

1. A method of controlling a heating cycle of a refrigeration system including a refrigerant circuit which includes a compressor having a suction port and an outlet having a discharge port with a hot gas compressor discharge line, a condenser for condensing the refrigerant, an evaporator for evaporating the refrigerant and an expansion valve, the method comprising:

using refrigerant from the hot gas compressor discharge line to heat the evaporator during a heating cycle, detecting periodically a discharge superheat of the refrigerant leaving the outlet of the compressor, producing a control signal representing a difference between the detected discharge superheat and a minimum discharge superheat setpoint, and adjusting the flow rate of the refrigerant to the suction port of the compressor according to the control signal so as to maintain the discharge superheat of the refrigerant at the outlet of the compressor substantially at the minimum discharge superheat setpoint.

2. The method according to claim 1, wherein the discharge superheat of the refrigerant leaving the outlet of the compressor is calculated as the difference between a compressor discharge temperature and a saturation temperature of the outlet of the compressor.

3. The method according to claim 2, wherein the compressor discharge temperature is measured by a sensor in contact with the refrigerant in the compressor.

4. The method according to claim 2, wherein the saturation temperature of the outlet of the compressor is calculated from a discharge pressure of the compressor measured by a pressure sensor in the outlet of the compressor.

5. The method according to claim 1 further comprising an injection valve that supplies the refrigerant to the suction port of the compressor, the flow rate of the refrigerant supplied being adjusted by varying the on-time of the injection valve using pulse-width modulated control signal.

6. The method according to claim 5, wherein the pulse-width modulated control signal is calculated as a percentage of a cycle time, the percentage being determined as the ratio of amount of superheat above the minimum discharge superheat setpoint and the difference between a maximum discharge superheat setpoint and minimum discharge superheat setpoint.

7. The method according to claim 5, wherein the on-time of the injection valve is bypassed if the refrigeration system is in a defrost mode.

8. The method according to claim 5 further comprising determining an ambient temperature outside of the refrigeration system, determining a temperature differential between a discharge air temperature and a return air temperature of a conditioned space in the refrigeration system, and bypassing the on-time of the injection valve if the ambient temperature is greater than or equal to an ambient temperature setpoint and the temperature differential is greater than a temperature differential setpoint.

9. The method according to claim 8, wherein the ambient temperature setpoint is 32° F. (0° C.) and the temperature differential setpoint is 7.2° F. (4° C.).

10. The method according to claim 5, wherein the on-time of the injection valve is bypassed if the discharge pressure of the compressor is greater than or equal to a discharge pressure setpoint.

11. The method according to claim 10, wherein the discharge pressure setpoint is 350 psig.

12. The method according to claim 5 further comprising bypassing the on-time of the injection valve if the compressor discharge superheat is less than or equal to the minimum discharge superheat setpoint.

13. The method according to claim 1 further comprising a receiver that collects refrigerant from the evaporator during a heating cycle, wherein the flow rate of the refrigerant to the suction port of the compressor is adjusted by an injection valve that fluidly connects the receiver to the suction port of the compressor.

14. The method according to claim 1 further comprising a microprocessor controller that produces the control signal representing a difference between the detected discharge superheat and a minimum discharge superheat setpoint, adjusting the flow rate of the refrigerant to the suction port of the compressor according to the control signal thereby so as to maintain the discharge superheat of the refrigerant at the outlet of the compressor substantially at the minimum discharge superheat setpoint.

15. The method according to claim 14 further comprising a receiver that collects refrigerant from the evaporator during a heating cycle, wherein the flow of the refrigerant to the suction port of the compressor is provided by an injection valve that fluidly connects the receiver to the suction port of the compressor, the flow rate of the injection valve being controlled by the control signal of the microprocessor controller.

* * * * *